US006840019B2

(12) United States Patent
Berg

(10) Patent No.: US 6,840,019 B2
(45) Date of Patent: Jan. 11, 2005

(54) METHOD AND APPARATUS TO ACHIEVE CONSISTENT SPACING BETWEEN LAYERS OF MODULAR CONSTRUCTION

(76) Inventor: Thomas J. Berg, P.O. Box 361, Mukwonago, WI (US) 53149

( * ) Notice: Subject to any disclaimer, the term of this patent is extended or adjusted under 35 U.S.C. 154(b) by 0 days.

(21) Appl. No.: 10/249,161

(22) Filed: Mar. 19, 2003

(65) Prior Publication Data

US 2004/0182029 A1 Sep. 23, 2004

(51) Int. Cl.[7] ..... E04C 5/16

(52) U.S. Cl. ..... 52/687; 52/379; 52/649.8; 52/742.16

(58) Field of Search ..... 52/677, 513, 686, 52/687, 712, 714, 562, 649.1, 649.8, 742.16, 379

(56) References Cited

U.S. PATENT DOCUMENTS

| | | | | | |
|---|---|---|---|---|---|
| 1,841,699 | A | * | 1/1932 | Bauman | 52/687 |
| 1,841,720 | A | * | 1/1932 | Emigholz | 52/687 |
| 4,034,529 | A | * | 7/1977 | Lampus | 52/426 |
| 4,793,104 | A | | 12/1988 | Hultberg et al. | |
| 4,865,781 | A | * | 9/1989 | Jennings | 264/35 |
| 5,852,907 | A | | 12/1998 | Tobin et al. | |
| 2001/0000844 | A1 | | 5/2001 | Kubica | |
| 2002/0017070 | A1 | | 2/2002 | Batch | |

FOREIGN PATENT DOCUMENTS

| | | | |
|---|---|---|---|
| DE | 20205592 | U1 | 8/2002 |
| GB | 2220430 | A | 1/1990 |
| WO | WO 9953154 | | 10/1999 |

* cited by examiner

*Primary Examiner*—Naoko Slack
(74) *Attorney, Agent, or Firm*—Ziolkowski Patent Solutions Group, LLC

(57) ABSTRACT

A spacer is provided that includes at least one rail of plastic, steel, rebar, or the like that runs along a top surface of a modular construction material such as a brick or block. At least one transverse rail is connected to the length-running rail. The transverse rail is also constructed of plastic, steel, rebar, or the like and runs width-wise along the top surface of the brick/block. Connected to the rails is a number of spacing studs that define a desired mortar depth. The spacing studs may include removable clips that are configured to engage the rails. Accordingly, the clips have a height equal to the desired mortar depth. The present invention may alternatively include a kit comprising the rails, clips, and bricks/blocks.

7 Claims, 4 Drawing Sheets

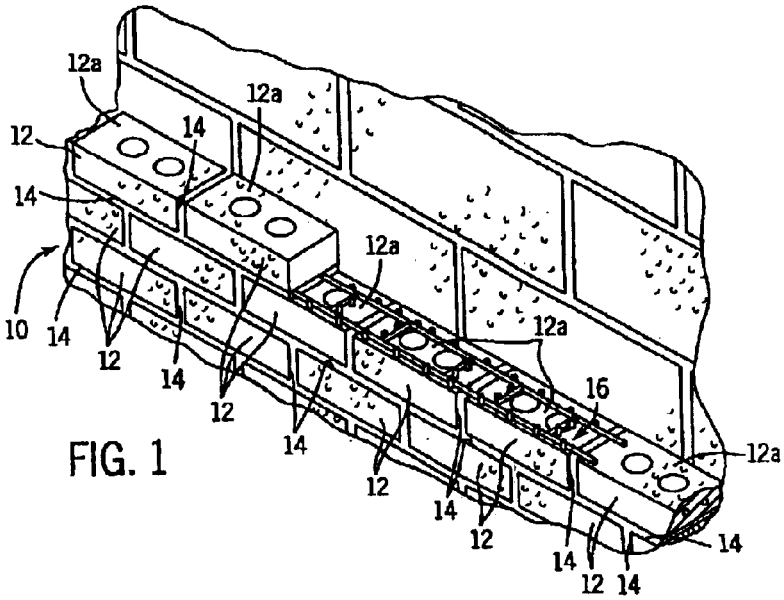
FIG. 1
FIG. 3
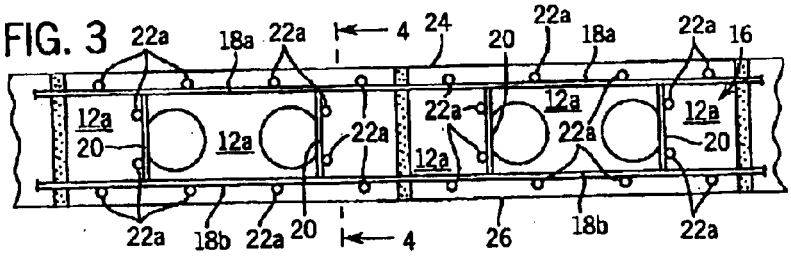
FIG. 4
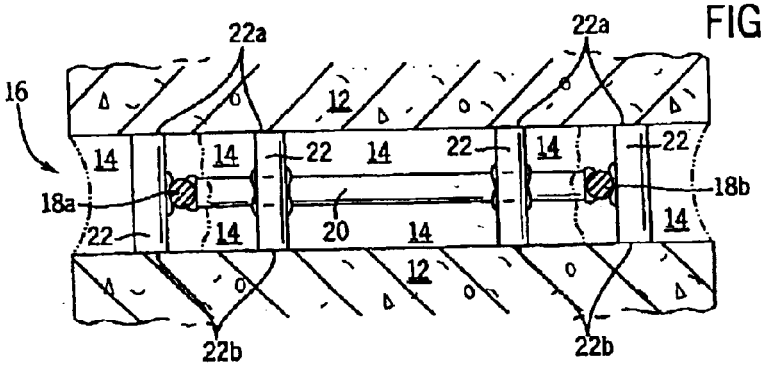

METHOD AND APPARATUS TO ACHIEVE CONSISTENT SPACING BETWEEN LAYERS OF MODULAR CONSTRUCTION

CROSS-REFERENCE TO RELATED APPLICATION

The present application is a continuation and claims priority of U.S. Pat. No. 6,553,737 which issued on Apr. 29, 2003.

BACKGROUND OF INVENTION

The present invention relates generally to brick and block wall construction and, more particularly, to a method and apparatus to achieve a consistent spacing between layers of bricks and/or blocks.

A number of construction techniques and devices/tools have been developed to assist masons and bricklayers in achieving a consistent and uniform spacing between layers of bricks and/or blocks of a constructed wall. Typically, the spacing between brick/block layers is occupied by mortar or some other adhesive material. A consistent and uniform mortar thickness not only adds to the aesthetic characteristics of a constructed wall but also provides structural stability that helps prevent premature strain on the structure that may lead to structure collapse.

These known spacers are limited however in application with bricks/blocks of different sizes. Known spacers primarily function to achieve an equal spacing between adjacent bricks/blocks of the same layer. Other spacers work to achieve a consistent thickness between layers, however, these spacers are particularly suited to cement blocks and are somewhat limited in application with bricks. These spacers typically include teeth that fill into interior cavities of the blocks, and as such, the spacers must be manufactured to fit a particular size block with specific cavity measurements. As a result, different spacers are needed for different size blocks and/or bricks.

It would therefore be desirable to design a construction tool that provides consistent spacing between brick layers of a constructed wall wherein the tool is applicable with bricks and blocks of multiple lengths and widths.

BRIEF DESCRIPTION OF INVENTION

The present invention is directed to a method and apparatus to achieve a consistent spacing between layers of bricks/blocks. A spacer is provided that includes at least one rail of plastic, steel, rebar, or the like that runs along a top surface of a brick/block. At least one transverse rail is connected to the length-running rail. The transverse rail is also constructed of plastic, steel, rebar, or the like and runs width-wise along the top surface of the brick/block. Connected to the rails is a number of spacing studs that define a desired mortar depth. The spacing studs may include removable clips that are configured to engage the rails. Accordingly, the clips have a height tantamount to the desired mortar depth. The present invention may alternatively include a kit comprising the rails, clips, and bricks/blocks.

In accordance with one aspect of the present invention, a spacer having first and second parallel rails extending along a length of a modular construction material is provided. The spacer also includes at least one connecting rod connecting the first and second parallel rails to another. A plurality of spring studs is also provided. The spacing studs are connected to the rails to define a desired mortar depth between modular construction material layers.

In accordance with another aspect of the present invention, a spacing apparatus is provided. The spacing apparatus is configured to achieve a relatively consistent mortar depth between modular construction material layers. The spacing apparatus includes at least one lengthwise rail extending along a length of at least one modular construction material and at least one transverse rail extending along a width of a modular construction material. The spacing apparatus also includes a number of clips wherein each clip has a height indicative of the desired mortar depth. Each clip is configured to removably engage a lengthwise rail or a transverse rail.

In accordance with a further aspect of the present invention, a spacing clip removably engagable with a pair of parallel rails extending along a length of a modular construction material is provided. The spacing clip includes a first end and a second end. Each end has a height equal to a desired mortar depth as well as a groove to receive a rail extending along the length of the modular construction material. The clip also includes a cross bar connecting the first end and the second end.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings:

FIG. 1 is a pictorial view of a modular construction material wall during construction incorporating a modular construction material spacer in accordance with the present invention.

FIG. 3 is a is a top view of a portion of that shown in FIG. 1.

FIG. 4 is a cross-sectional view of FIG. 3 taken along line 4—4.

DETAILED DESCRIPTION

Figure 2:
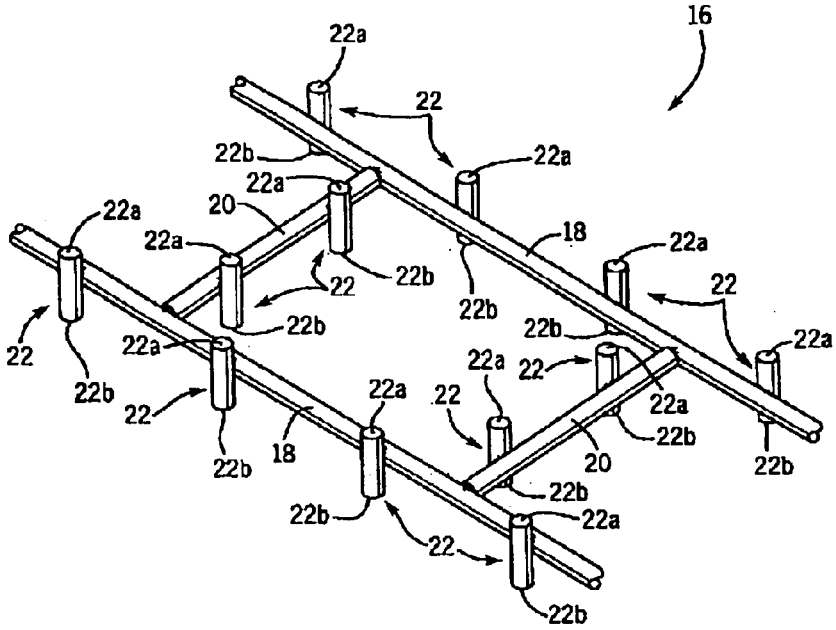
FIG. 2 is a perspective view of one embodiment of the present invention.

The present invention will be described with respect to a spacing apparatus that may be used during construction of a wall out of modular construction materials. Herein, the terms "brick" and "block" may be interchanged and used to describe any modular construction material used for wall construction.

FIG. 1 is a pictorial view of a brick wall during construction incorporating one embodiment of the present invention. The wall 10 includes a number of bricks 12 that are arranged in layers in accordance with known construction techniques. Each brick 12 is securely positioned with a layer of adhesive material 14 such as mortar. To achieve a uniform and consistent spacing between each layer of bricks, a spacer 16 is implemented. The spacer 16 is designed to be positioned along a top surface 12*a* of the bricks.

Referring to FIG. 2, in one embodiment, spacer 16 includes a pair of parallel rails 18. The rails 18 extend length-wise along a top surface of the bricks. Connecting rails 18 are a pair of transverse connecting rods 20. The connecting rods provide stability to the spacer and extend across the width of the brick. Affixed to the rails 18 and rods 20 are a number of spacing studs 22. Studs 22 have a height defining a desired adhesive or mortar depth. Each stud includes a first end 22*a* and a second end 22*b*. End 22*a* extends upwardly from the rail or rod whereas end 22*b* extends downwardly. End 22*a* is designed to abut the under surface of a laid brick whereas end 22*b* is designed to abut the top surface of a laid brick. Alternatively, spacer 16 may include a single rail 18 extending along a center length of the brick with at least one rod 20 extending along a width of the brick. Preferably, spacer 16 is formed of galvanized steel but may be fabricated from other materials such as plastic, polymer composites, or the like.

Referring now to FIG. 3, a top view of a portion of that shown in FIG. 1 is illustrated. As illustrated, rails 18 are ideally positioned on the top surface 12*a* of a secured brick such that the distance between a first rail 18*a* and the edge 24 of the brick 12 is the same as the distance between second rail 18*b* and an opposite edge 26 of brick 12. As further illustrated, rails 18*a*, 18*b* extend length-wise along the top surface of each brick of the layer. However, a modular spacer is also contemplated wherein multiple spacers are linearly connected to form a spacer that extends along the length of the entire brick layer.

Referring now to FIG. 4, a cross-sectional view of FIG. 3 taken along line 4—4, the consistent mortar depth achieved with brick spacer 16 is illustrated. As illustrated, studs 22 define a desired mortar depth between layers of bricks 12. As also illustrated, spacer 16 is permanently secured with mortar 14 between the layers of bricks 12. As such, spacer 16 helps maintain the stability of the finished wall or structure.

Heretofore described is a spacer 16 wherein the rails 18 and the connecting rod 20 are molded or cast in a single unitized assembly. Additionally, rod 20 may be welded to rails 18*a*, 18*b*. However, in another embodiment, connecting rod 20 may be incorporated as an independent spacing clip, as will be described with respect to FIGS. 5–7.

Figure 5:
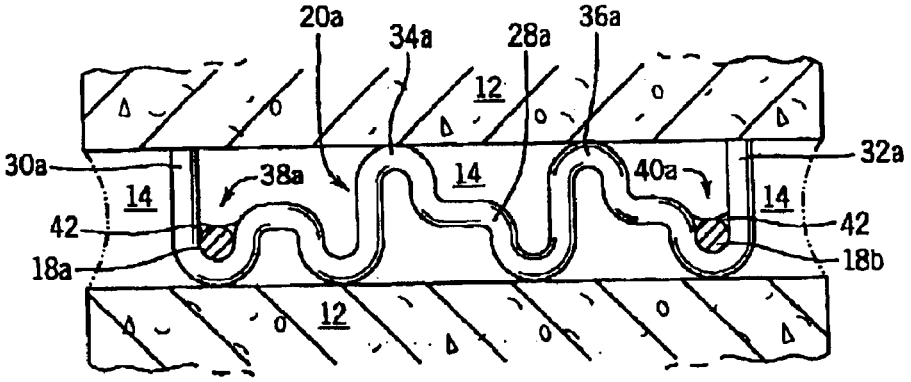
FIG. 5 is a is a side elevational view of an alternate embodiment of the present invention.

Referring now to FIG. 5, connecting rod 20*a* is illustrated in engagement with rails 18*a*, 18*b*. Rod 20*a*, in this embodiment, includes a curvilinear or sinusoidally-shaped connecting section 28*a* connecting a first end 30*a* and a second end 32*a* to one another. Each end 30*a*, 32*a* as well as portions 34*a*, 36*a* of the connecting section 28*a* have a height equal to a desired mortar depth. At each end 30*a*, 32*a* is a groove 38*a*, 40*a* configured to receive rails 18*a*, 18*b*, respectively. Each U-shaped groove 38*a*, 40*a* has a diameter or width sufficient to securely engage the diameter of rails 18*a*, 18*b*. Connecting rod 20*a* is designed to securely receive rails 18*a*, 18*b*. To further secure the rails 18*a*, 18*b* within grooves 38*a*, 40*a* welding material 42 may be implemented.

Figure 6:
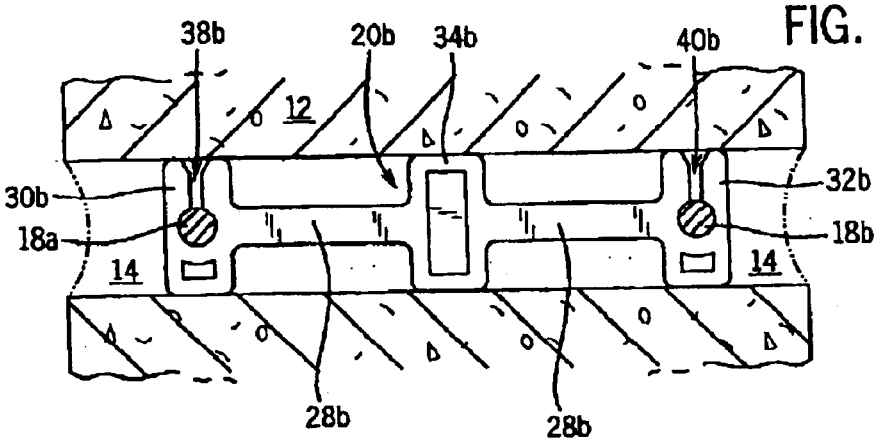
FIG. 6 is a side elevational view of an alternate embodiment of the present invention.

Referring now to FIG. 6, an alternate connecting rod 20*b* is illustrated. Connecting rod 20*b* includes a first end 30*b* and a second end 32*b* connected by a connecting section 28*b*. Each end 30*b*, 32*b* and intermediate portion 34*b* have a height equal to a desired mortar depth. Grooves 38*b*, 40*b* are configured to receive rails 18*a*, 18*b*. One intermediate portion 34*b* is shown, but clip 20*b* may include more than one intermediate portion. Preferably, each intermediate position is equidistantly positioned along connecting section 28*b*. Each groove 38*b*, 40*b* is designed to engage a corresponding groove (not shown) of rail 18*a*, 18*b*. Alternately, each end 38*b*, 40*b* is fabricated from a resilient material that may be flexed such that the grooves 38*b*, 40*b* can be temporarily widened to engage rails 18*a*, 18*b*.

Figure 7:
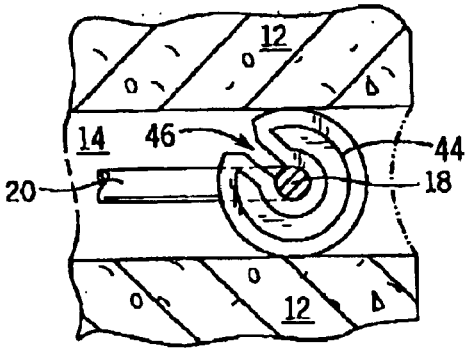
FIG. 7 is a side elevational view of an alternate embodiment of the present invention.

Referring now to FIG. 7, another embodiment of a clip is shown. Clip 44 is designed to engage a rail 18 independent of a transverse rod 20. That is, clip 44 may be positioned anywhere along the length of rail 18 and is not necessarily connected to connecting rod 20. Clip 44 has a circular cross-section with a diameter equal to the desired mortar depth. Groove 46 is configured to receive rail 18 and has a width equal to the diameter of rail 18. The number of clips 44 utilized along each rail is a matter of design choice, but a sufficient number to adequately support the length of the rail should be used.

Figure 8:
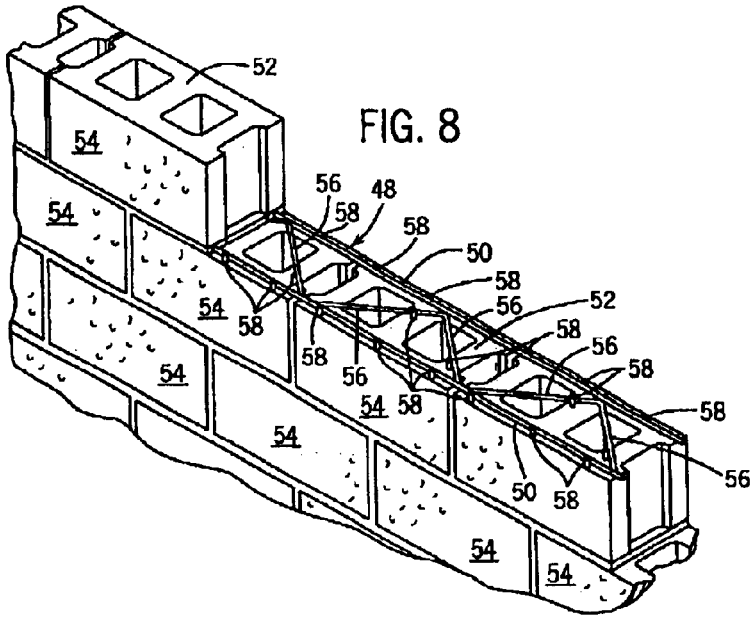
FIG. 8 is a pictorial view of a cement block wall during construction incorporating a spacer in accordance with the present invention.

FIG. 8 is a pictorial view of a cement block wall incorporating a spacing apparatus particularly useful for cement blocks. Spacer 48 includes a pair of rails 50 extending along a top surface 52 of blocks 54. Diagonally connecting rails 50 is a connecting rod 56. To achieve a desired mortar depth, a number of spacing studs 58 or clips similar to those heretofore described are attached to the rails 50 and rod 56.

To achieve a consistent and uniform spacing between layers of bricks and/or blocks, a mason or bricklayer positions a spacer along a top surface of the brick or blocks. Mortar is then placed over the spacer and bricks/blocks. Preferably, an excessive amount of mortar is used such that the placement of the next layer of bricks or blocks causes the mortar to compact and fill any gaps or space between the layers. The excessive mortar that is excreted from between the bricks/blocks and is then removed so that mortar is not wasted and the finished wall is aesthetically pleasing. The spacers heretofore described permanently remain between the layers of bricks/blocks and become part of the finished product or construction.

In accordance with one embodiment of the present invention, a spacer having first and second parallel rails extending along a length of a modular construction material is provided. The spacer also includes at least one connecting rod connecting the first and second parallel rails to another. A plurality of spring studs is also provided. The spacing studs are connected to the rails to define a desired mortar depth between construction layers.

In accordance with another embodiment of the present invention, a spacing apparatus is provided. The spacing apparatus is configured to achieve a relatively consistent mortar depth between layers of modular construction material. The spacing apparatus includes at least one rail extending along a length of at least one modular construction material and at least one transverse rail extending along a width of a modular construction material. The spacing apparatus also includes a number of clips wherein each clip has a height indicative of the desired mortar depth. Each clip is configured to removably engage a rail or a transverse rail.

In accordance with a further embodiment of the present invention, a spacing clip removably engagable with a pair of parallel rails extending along a length of a modular construction material is provided. The spacing clip includes a first end and a second end. Each end has a height equal to a desired mortar depth as well as a groove to receive a rail extending along the length of the modular construction material. The clip also includes a cross bar connecting the first end and the second end.

The present invention has been described in terms of the preferred embodiment, and it is recognized that equivalents, alternatives, and modifications, aside from those expressly stated, are possible and within the scope of the appending claims.

What is claimed is:

1. A spacing clip incorporated into a kit comprising a number of bricks/blocks and a number of rails, each rail extendable along a length of a brick/block, the clip removably engageable with a pair of parallel rails extending along a length of a modular construction material, and having:

a first end and a second end, wherein each end has a height equal to a desired mortar depth and includes a groove configured to securely engage a rail extending along a length of a modular construction material; and a cross-bar connecting the first end and the second end.

2. The spacing clip of claim 1 wherein the cross-bar and the first end and the second end are integrally connected in a single unitized structure.

3. The spacing clip of claim 1 wherein the cross-bar includes a stud centrally positioned between the first end and the second end and having a height equal to the desired mortar depth.

4. The spacing clip of claim 1 wherein the cross-bar has a curvilinear shape.

5. A spacing clip incorporated into a kit comprising a number of bricks/blocks and a number of rails, each rail extendable along a length of a brick/block, the clip removably engageable with a first and a second rail extending parallel to another along a length of a masonry object, and comprising:

a first end having a channel to snugly receive a first rail;

a second end having a channel to snugly receive a second rail; and a cross-bar having a post configured to engage a masonry object at one end and engage another masonry object at an opposite end.

6. The spacing clip of claim 5 wherein the first end, the second end, and the post each have a height equal to a desired mortar depth.

7. The spacing clip of claim 5 wherein the post is centrally positioned between the first end and the second end.

* * * * *